US006929079B2

(12) United States Patent
McDonough et al.

(10) Patent No.: US 6,929,079 B2
(45) Date of Patent: Aug. 16, 2005

(54) DRILL BIT CUTTER ELEMENT HAVING MULTIPLE CUSPS

(75) Inventors: Scott McDonough, Houston, TX (US); Vincent W. Shotton, Ponca City, OK (US); Zhou Yong, Spring, TX (US)

(73) Assignee: Smith International, Inc., Houston, TX (US)

( * ) Notice: Subject to any disclaimer, the term of this patent is extended or adjusted under 35 U.S.C. 154(b) by 323 days.

(21) Appl. No.: 10/371,388

(22) Filed: Feb. 21, 2003

(65) Prior Publication Data

US 2004/0163851 A1 Aug. 26, 2004

(51) Int. Cl.[7] ..... E21B 10/36
(52) U.S. Cl. ..... 175/420.1; 175/431; 175/430
(58) Field of Search ..... 175/431, 430, 175/378, 426, 420.1, 397, 421, 398

(56) References Cited

U.S. PATENT DOCUMENTS

| | | | | | |
|---|---|---|---|---|---|
| 2,578,593 | A | | 12/1951 | Phipps | 255/61 |
| 3,388,757 | A | | 6/1968 | Fittinger | 175/410 |
| 3,442,352 | A | | 5/1969 | McElya et al. | 175/374 |
| 3,946,820 | A | | 3/1976 | Knapp | 175/341 |
| 4,056,153 | A | | 11/1977 | Miglierini | 175/341 |
| 4,058,177 | A | | 11/1977 | Langford, Jr. et al. | 175/374 |
| 4,086,973 | A | | 5/1978 | Keller et al. | 175/374 |
| 4,108,260 | A | | 8/1978 | Bozarth | 175/374 |
| 4,334,586 | A | | 6/1982 | Schumacher | 175/374 |
| 4,352,400 | A | | 10/1982 | Grappendorf et al. | 175/330 |
| 4,511,006 | A | | 4/1985 | Grainger | 175/57 |
| 4,586,574 | A | * | 5/1986 | Grappendorf | 175/434 |
| 4,716,977 | A | | 1/1988 | Huffstutler | 175/410 |
| 4,722,405 | A | | 2/1988 | Langford, Jr. | 175/374 |
| 4,832,139 | A | | 5/1989 | Minikus et al. | 175/374 |
| 4,951,762 | A | | 8/1990 | Lundell | 175/410 |
| D324,527 | S | | 3/1992 | Slutz | D15/139 |
| 5,131,478 | A | * | 7/1992 | Brett et al. | 175/57 |
| 5,172,777 | A | | 12/1992 | Siracki et al. | 175/374 |
| 5,172,779 | A | | 12/1992 | Siracki et al. | 175/420 |

(Continued)

FOREIGN PATENT DOCUMENTS

| | | | |
|---|---|---|---|
| EP | 0391683 A1 | 10/1990 | E21B/10/48 |
| EP | 0 446 765 A1 | 9/1991 | E21B/10/46 |
| EP | 0 527 506 A2 | 2/1993 | E21B/10/52 |
| EP | 0902159 A2 | 3/1999 | E21B/10/56 |
| GB | 2361497 A | 10/2001 | E21B/10/16 |
| GB | 2369841 A | 6/2002 | E21B/10/46 |
| GB | 2393982 A | 4/2004 | E21B/10/46 |
| RU | 2105124 C1 | 2/1998 | |
| RU | 2153569 C2 | 7/2000 | |

OTHER PUBLICATIONS

Search Report for Appln. No. GB0402108.5, dated Apr. 22, 2004; (1 p.).
Search Report for Appln. No. GB0403620.8, dated May 5, 2004; (2 p.).

*Primary Examiner*—Frank S. Tsay
(74) *Attorney, Agent, or Firm*—Conley Rose, P.C.

(57) ABSTRACT

Cutter elements for use in rolling cones rock bits are disclosed having a crown that includes multiple, spaced-apart cusps for enhancing formation removal by creating overlapping Hertzian contact zones. The cusps may be partially dome-shaped, berm shaped or otherwise. The cutter elements provide multiple cutting edges for engaging the formation and may have differing radii and extension length as suitable for particular applications.

65 Claims, 12 Drawing Sheets

U.S. PATENT DOCUMENTS 5,197,555 A 3/1993 Estes ..... 175/431
5,201,376 A 4/1993 Williams ..... 175/374
5,303,787 A 4/1994 Brady ..... 175/430
5,322,138 A 6/1994 Siracki ..... 175/374
5,323,865 A 6/1994 Isbell et al. ..... 175/378
5,341,890 A 8/1994 Cawthorne et al. ..... 175/374
5,351,768 A 10/1994 Scott et al. ..... 175/374
5,372,210 A 12/1994 Harrell ..... 175/431
5,407,022 A 4/1995 Scott et al. ..... 175/331
5,415,244 A 5/1995 Portwood ..... 175/374
5,421,423 A 6/1995 Huffstutler ..... 175/374
5,421,424 A 6/1995 Portwood et al. ..... 175/374
5,429,199 A 7/1995 Sheirer et al. ..... 175/321
5,429,200 A 7/1995 Blackman et al. ..... 175/371
5,452,771 A 9/1995 Blackman et al. ..... 175/353
5,479,997 A 1/1996 Scott et al. ..... 175/374
5,518,077 A 5/1996 Blackman et al. ..... 175/353
5,535,839 A * 7/1996 Brady ..... 175/427
5,542,485 A 8/1996 Pessier et al. ..... 175/371
5,560,440 A * 10/1996 Tibbitts ..... 175/384
5,592,995 A 1/1997 Scott et al. ..... 175/374
5,636,700 A 6/1997 Shamburger, Jr. ..... 175/331
5,644,956 A 7/1997 Blackman et al. ..... 76/108.2
5,695,019 A 12/1997 Shamburger, Jr. ..... 175/333
5,697,462 A 12/1997 Grimes et al. ..... 175/374
5,709,278 A 1/1998 Crawford ..... 175/374
5,746,280 A 5/1998 Scott et al. ..... 175/374
5,752,573 A 5/1998 Scott et al. ..... 175/374
5,755,301 A 5/1998 Love et al. ..... 175/426
5,813,485 A 9/1998 Portwood ..... 175/430
5,819,861 A 10/1998 Scott et al. ..... 175/371
5,833,020 A 11/1998 Portwood et al. ..... 175/331
5,839,526 A 11/1998 Cisneros et al. ..... 175/431
5,871,060 A * 2/1999 Jensen et al. ..... 175/420.2
5,874,060 A 2/1999 Armour et al. ..... 424/1.49
5,881,828 A 3/1999 Fischer et al. ..... 175/374
5,887,655 A 3/1999 Haugen et al. ..... 166/298
5,887,668 A 3/1999 Haugen et al. ..... 175/79
5,890,550 A 4/1999 Swadi et al. ..... 175/374
5,915,486 A 6/1999 Portwood et al. ..... 175/374
5,950,745 A * 9/1999 Ingmarsson ..... 175/420.2
5,967,245 A 10/1999 Garcia et al. ..... 175/374
6,029,759 A 2/2000 Sue et al. ..... 175/374
6,053,263 A 4/2000 Meiners ..... 175/331
6,059,054 A 5/2000 Portwood et al. ..... 175/430
6,105,693 A * 8/2000 Ingmarsson ..... 175/414
D430,578 S 9/2000 Brady ..... D15/21
6,176,332 B1 1/2001 Massa et al. ..... 175/420.1
6,176,333 B1 1/2001 Doster ..... 175/428
6,196,340 B1 * 3/2001 Jensen et al. ..... 175/431
6,202,752 B1 3/2001 Kuck et al. ..... 166/298
6,241,034 B1 6/2001 Steinke et al. ..... 175/331
6,595,305 B1 7/2003 Dunn et al. ..... 175/420.1
6,601,662 B2 8/2003 Matthias et al. ..... 175/374

* cited by examiner

DRILL BIT CUTTER ELEMENT HAVING MULTIPLE CUSPS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to earth boring bits used to drill bit a borehole for the ultimate recovery of oil, gas, or minerals. More particularly, the invention relates to rolling cone rock bits and to an improved cutting structure and cutter elements for such bits. Still more particularly, the invention relates to enhancements in cutter element shape and orientation in the drill bit.

2. Description of the Related Art

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and fracturing the formation material in its path. The rotatable cone cutters may be described as generally conical in shape and are therefore referred to as rolling cones.

Rolling cone bits typically include a bit body with a plurality of journal segment legs. The rolling cones are mounted on bearing pin shafts that extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are commonly known as "steel tooth bits." In each instance, the cutter elements on the rotating cone cutters breakup the formation to form new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted location. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon is ability to "hold gage" (meaning its ability to maintain a full gage borehole diameter), its rate of penetration ("ROP"), as well as its durability or ability to maintain an acceptable ROP. The from and positioning of the cutter elements (both steel teeth and tungsten carbide inserts) upon the cone cutters greatly impact bit durability and ROP and thus, are critical to the success of a particular bit design.

The inserts in TCI bits are typically inserted in circumferential rows on the rolling cone cutters. Most such bits include a row of inserts in the heel surface of the cone cutters. The heel surface is a generally frustoconical surface and is configured and positioned so as to align generally with and ream the sidewall of the borehole as the bit rotates.

In addition to the heel row inserts, conventional bits typically include a circumferential gage row of cutter elements mounted adjacent to the heel surface but oriented and sized so as to cut the corner of the borehole. In performing their corner cutting duty, gage row inserts perform a reaming function, as a portion of the insert scraps or reams the side of the borehole. Gage row inserts also perform bottom hole cutting, a duty in which the insert gouge the formation material at the bottom of the borehole.

Conventional bits also include a number of additional rows of cutter elements that are located on the cones in circumferential rows disposed radially inward or in board from the gage row. These cutter elements are sized and configured for cutting the bottom of the borehole, and are typically described as inner row cutter elements.

Earthen formations generally undergo two types of fractures when penetrated by a cutter element that protrudes from a rolling cone of a drill bit. A first type of fracture is generally referred to as a plastic fracture, and is the type of fracture where the cutter element penetrates into the rock and volumetrically displaces the rock by compressing it. In this circumstance, shearing or tearing fracture, rather than tensile fracture, is the major mode of crack propagation. This type of fracture generally creates a crater in the rock that is the size and shape of that portion of the cutter element that has penetrated into the rock.

A second principal type of fracture is what is referred to as a brittle fracture. A brittle fracture typically occurs after a plastic fracture has first taken place. That is, when the rock first undergoes plastic fracture, a region around the crater made by the cutter element will experience increased tensile stress and will weaken and may crack in that region, even though the rock in that region surrounding the crater has not been displaced. This region of increased stress is generally recognized as the "Hertzian" contact zone. However, in certain formations, when the cutter element displaces enough of the rock and creates enough stress in the Hertzian contact zone adjacent to the plastic fracture, that rock in the region of increased stress may itself break and chip away from the crater. Where this occurs, the cutter element effectively removes a volume of rock that is larger than the volume of rock displaced in the plastic fracture.

The characteristics of these fractures depend largely on the geometry of the cutter element and the properties of the rock that is being penetrated. In general, for a given formation, a sharper insert will generally create more of a plastic fracture whereas, a more blunt cutter element will produce more of a brittle fracture. The more blunt insert will typically require a higher force, however, to penetrate to the same depth into the rock as compared to a sharper cutter element. Because a brittle fracture removes more rock material than a plastic fracture, it would be advantageous to provide a cutter element suitable for inducing brittle fractures that would perform that function without requiring increased force or weight on bit. Thus, to increase a bit's rate of penetration (ROP), it is desirable to increase the bit's ability to initiate brittle fractures at the locations where the cutter element engages the formation material so that the volume of rock removed by each hit or impact of the cutter element is greater than the volume of rock actually penetrated by the cutter element.

A variety of different shapes of cutter elements have been devised. In most instances, each cutter element is designed to optimize the amount of formation material that is removed with each "hit" of the formation by the cutter element. At the same time, however, the shape and design of a particular cutter element is also dependent upon the location in the drill bit in which it is to be placed, and thus the cutting duty to be performed by that cutter element. For example, in general, heel row cutter elements are generally made of a harder and more wear resistant material, and have a less aggressive cutting shape for reaming the borehole side wall, as compared to the inner row cutter elements where the cutting duty is more of a gouging, digging and crushing action. Thus, in general, bottom hole cutter elements generally tend to have more aggressive cutting shapes than heel row cutters.

It is understood that cutter elements, depending upon their location in the rolling cone cutter, have different cutting trajectories as the cone cutter rotates in the borehole. Thus, conventional cutter elements have been oriented in the rolling cone cutters in a direction believed to cause optimal formation removal. However, it is now understood that cutter elements located in certain portions of the cone cutter have more than one cutting mode. More particularly, cutter elements in the inner rows of the cone cutters, particularly those closest to the nose of the cone cutter (and the center line of the bit), include a twisting motion as they gouge into and then separate from the formation. Unfortunately, however, conventional cutter elements, such as a chisel shaped insert, having a single primary cutting edge, are usually oriented to optimize the cutting that takes place only in the cutter's circumferential cutting trajectory, as they do not have particular features to take advantage of cutting opportunities as the cutter element twists.

Accordingly, to provide a drill bit with higher ROP, and thus to lower drilling costs incurred in the recovery of oil and other valuable resources, it would be desirable to provide cutter elements designed and oriented so as to enhance brittle fracture of the rock formation being drilled, and to present to the formation multiple cutting edges as the cutting surface of the cutter element rotates through its cutting trajectory so as to take advantage of multiple cutting modes.

SUMMARY OF THE PREFERRED EMBODIMENTS OF THE INVENTION

Described herein is an enhanced cutter element for use in a rolling cone drill bit particularly suited for enhancing brittle rock formation and increasing ROP of a bit. The cutter element includes a base portion and a cutting portion extending from the base, the cutting portion including a crown on the cutting surface having a plurality of spaced-apart cusps with valleys between the cusps. The cusps may be partial dome-shaped cusps of the same or differing radius of curvature. Further, the cusps may extend the same distance from the base or, alternatively, the cusps may differ in extension. In certain embodiments, it is desirable to provide a cutting portion that extends beyond the outer profile of the base. The spaced-apart cusps impact the formation material and create a relatively large Hertzian contact zone to enhance formation material relative to a conventional conical insert of similar diameter and extension.

The cutter elements described herein may be placed in various rows in the cone cutter; however, certain cutter elements include features that provide greater enhancements when used in particular rows. For example, cutter elements described herein having relatively short extensions may, in many cases, be better suited for use in the heel row for scraping the side wall of the borehole. In addition to partial dome-shaped cusps, the cutter elements may include a plurality of berm-shaped cusps circumferentially disposed about the cutting surface crown with valleys separating the berms so as to create a crenellated crown. Central to the circumferentially disposed berms may be a central recess or a central cusp that is separated from the surrounding berms by a circumferential valley. The cutting surface provided by such structure provides a myriad of cutting edges. The upper surface of the berm like cusps may themselves include projections or apexes that are separated by a saddle. Such a cutter element offers still further cutting edges to the formation material.

Thus, the embodiments described herein comprise a combination of features and advantages which overcome some of the deficiencies or shortcomings of prior bits and cutter element designs. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF PREFERRED EMBODIMENTS

Figure 1:
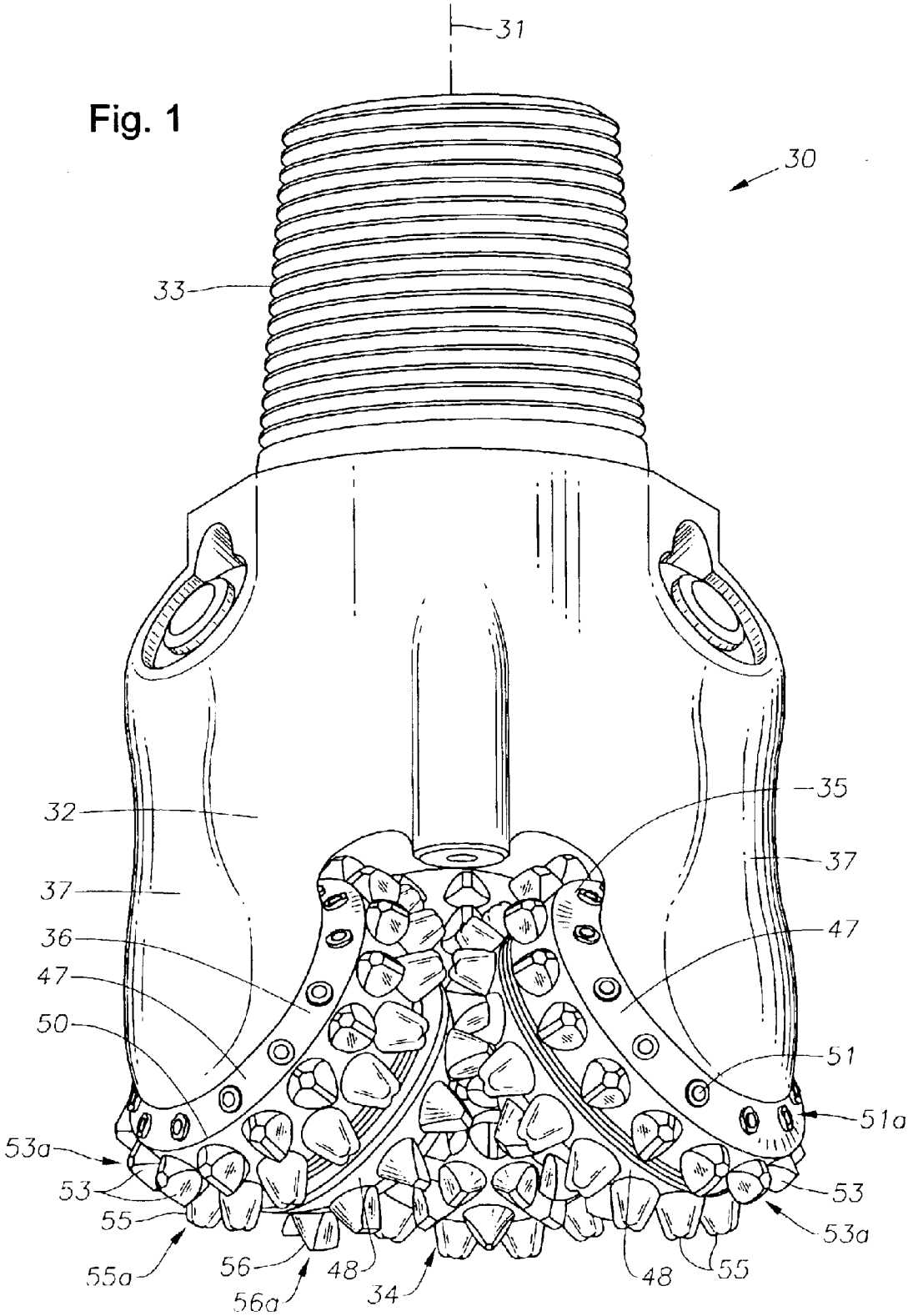
FIG. 1 is a perspective view of an earth boring bit.

Referring first to FIG. 1, an earth-boring bit 30 includes a central axis 31 and a bit body 32 having a threaded section 33 on its upper end for securing the bit to the drill string (not shown). Bit 30 has a predetermined gage diameter as defined by three rolling cone cutters 34, 35, 36 rotatably mounted on bearing shafts (not shown) that extend from the bit body 32. The present invention will be understood with a detailed description of one such cone cutter 34, with cones 35, 36 being similarly, although not necessarily identically, configured. Bit body 32 is composed of three sections, or legs 37 (two shown in FIG. 1), that are joined together to form bit body 32.

Figure 2:
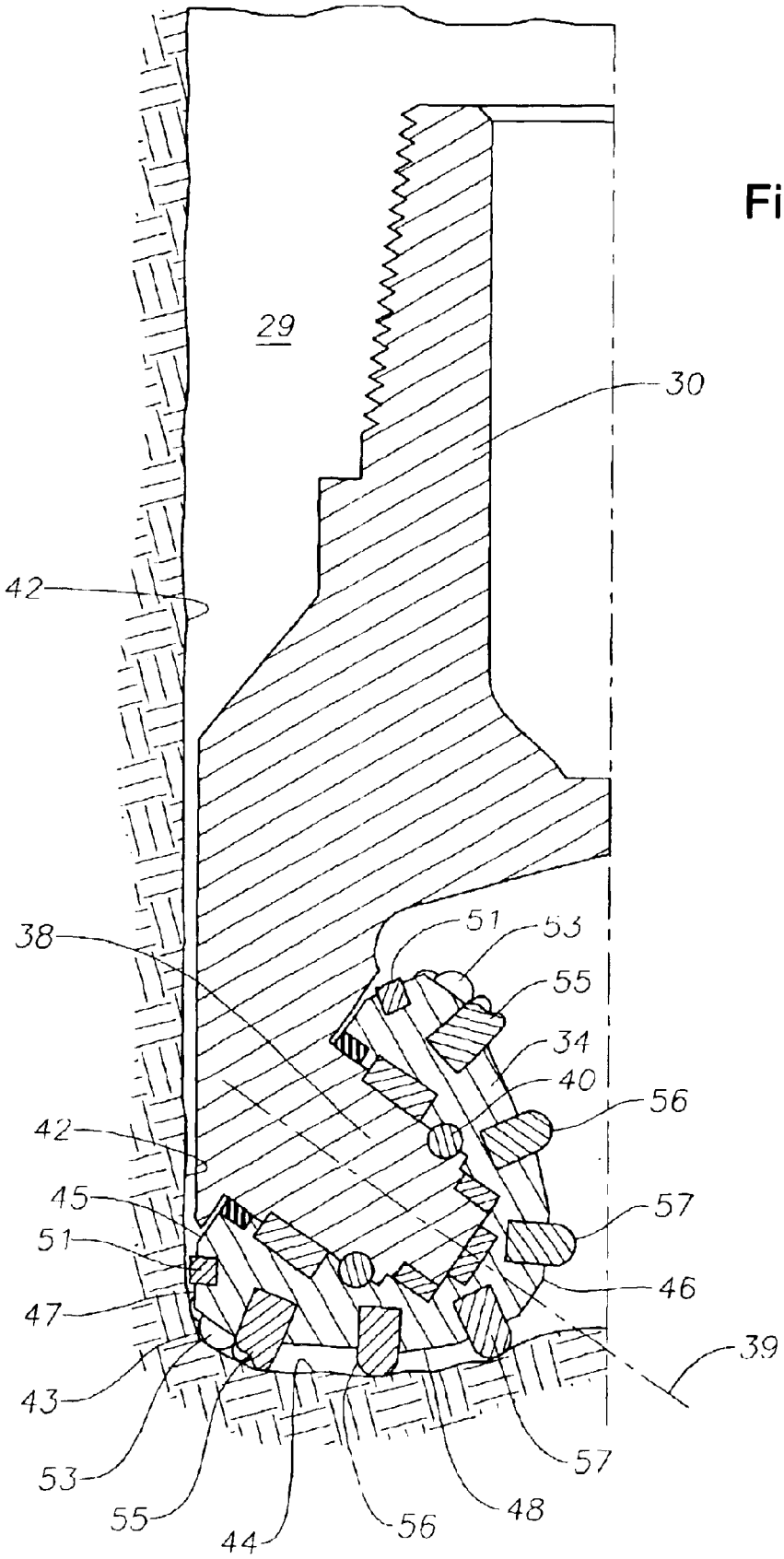
FIG. 2 is a partial section view taken through one leg and one rolling cone cutter of the bit shown in FIG. 1.

Referring now to FIG. 2, bit 30 is shown inside a borehole 29 that includes sidewall 42, corner portion 43 and bottom 44. Cone cutter 34 is rotatably mounted on a pin or journal 38, with the cone's axis of rotation 39 oriented generally downward and inward towards the center of bit 30. Cone cutter 34 is secured on pin 38 by ball bearings 40.

Referring now to FIGS. 1 and 2, each cone cutter 34–36 includes a backface 45 and nose portion 46 generally opposite backface 45. Cutters 34–36 further include a frustoconical heel surface 47. Frustoconical surface 47 is referred to herein as the "heel" surface of cutters 34–36, it being understood, however, that the same surface may sometimes be referred to by others in the art as the "gage" surface of a rolling cone cutter. Extending between heel surface 47 and nose 46 is a generally conical surface 48 adapted for supporting cutter elements which gouge or crush the borehole bottom 44 as the cone cutters 34–36 rotate about the borehole. Frustoconical heel surface 47 and conical surface 48 converge in a circumferential edge or shoulder 50 (FIG. 1).

Cone cutters 34–36 include a plurality of tooth-like cutter elements for gouging, scraping and chipping away the surfaces of the borehole. The cutter elements retained in cone cutter 34 include a plurality of heel row inserts 51 that are secured in a circumferential row 51*a* in the frustoconical heel surface 47. Cone cutter 34 further includes a circumferential row 53*a* of gage inserts 53 secured to cone cutter 34 in locations along or near the circumferential shoulder 50. Cone cutter 34 also includes a plurality of inner row inserts, such as inserts 55, 56, 57 secured to the generally conical cone surface 48 and arranged in spaced-apart inner rows such as 55*a*, 56*a*.

Referring again to FIG. 2, heel inserts 51 generally function to scrape or ream the borehole sidewall 42 to maintain the borehole at full gage and prevent erosion and abrasion of heel surface 47. Gage row cutter elements 53 cut the corner of the borehole and endure side wall and bottom hole forces as they perform their cutting duty. Inner row cutter elements 55–57 are employed primarily to gouge and crush and thereby remove formation material from the borehole bottom 44. Inner rows 55*a*, 56*a*, 57*a*, are arranged and spaced on cone cutter 34 so as not to interfere with the inner rows on each of the other cone cutters 35, 36.

Figure 3:
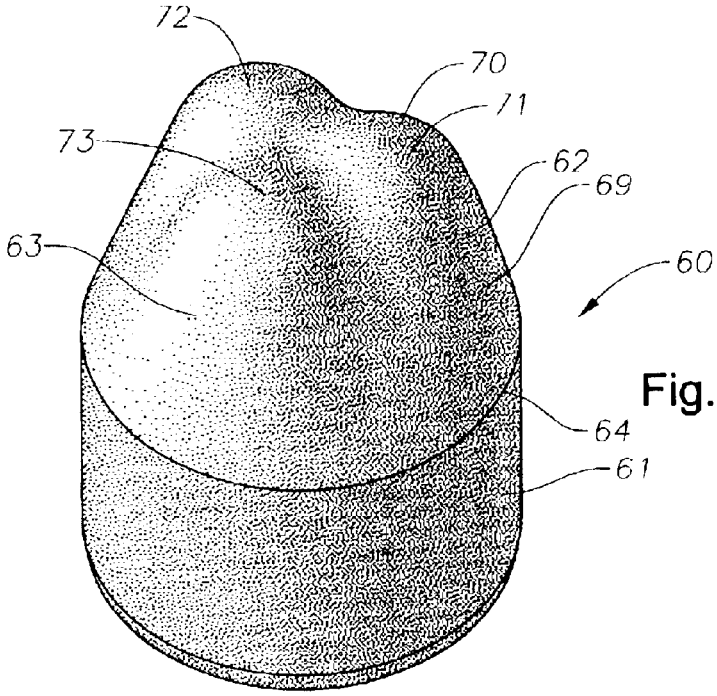
FIGS. 3–5 are, respectively, perspective, front elevation, and a top view of a first cutter element having particular application in a rolling cone bit such as that shown in FIGS. 1 and 2.
Figure 4:
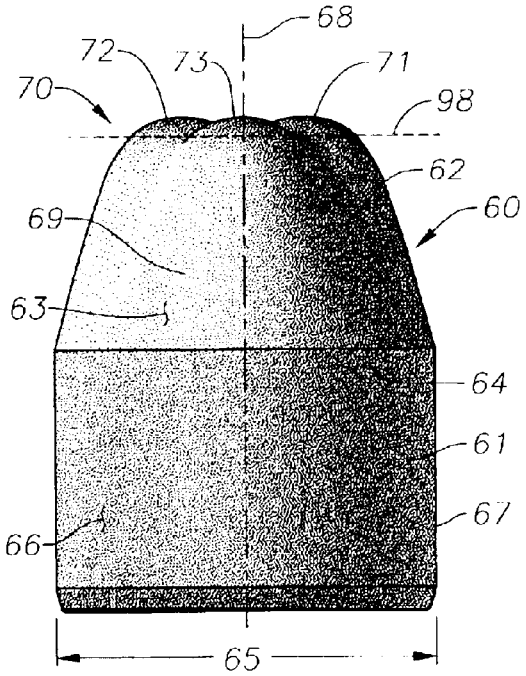
Figure 5:
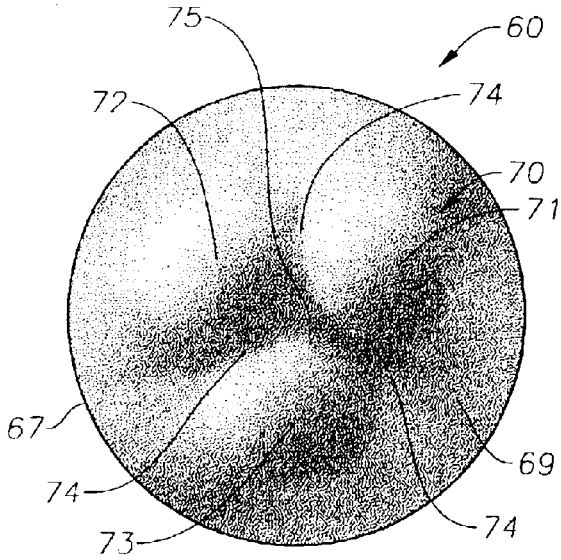

Referring now to FIGS. 3–5, there is shown a cutter element in a form of an insert 60 having particular utility for use as an inner row cutter in cone cutters 34–36 of rolling cone drill bit 30. Insert 60 includes a barrel or base portion 61, central axis 68, and a cutting portion 62 extending from the base. Cutting portion 62 includes cutting surface 63 which meets base 61 at intersection 64. Base 61 has a generally cylindrical surface 66 and diameter 65 forming an outer profile 67 of the cutter element. Base portions having noncircular outer profiles may also be employed. The cutter element base 61 is retained within a cone cutter such that only cutting surface 63 extends above the cone steel.

Preferably, cutting surface 63 is continuously contoured and includes a crown 70 and a side surface 69 extending between base 61 and crown 70. As used herein, the term "continuously contoured" refers to surfaces that can be described as having continuously curved surfaces that are free of relatively small radii (typically less than 0.08 inches) that are conventionally used to break sharp edges or round off transitions between adjacent distinct surfaces. Crown 70 includes cusps 71, 72, 73 that extend upwardly in a direction away from base 61. In this embodiment, cusps 71–73 of crown 70 are formed to be equal distance from cutter axis 68, and each includes a partial dome-shaped distal surface having a spherical radius of curvature, with the radius of curvature of each cusp 71–73 being substantially the same. As used herein, what is meant by "cusp" is a projection extending from the crown 70 and spaced from other such projections such that a planar cross-section of the crown 70 taken perpendicular to the cutter axis 68 intersects the crown 70 in a plurality of spaced apart closed figures when the section is taken at at least one axial position. Thus, it is understood with reference to FIG. 4, a cross-section of crown 70 at plane 98 will yield a cross-section having three spaced-apart, circular closed figures, each represented of the intersection of plane 98 with a cusp 71–73. Valleys 74 separate each cusp 71–73. Central to crown 70 is a central recess 75 at the intersection of valleys 74 which forms a lower most region on crown 70. Cutter element axis 68 extends longitudinally through insert 60 and passes through central recess 75.

Figure 6:
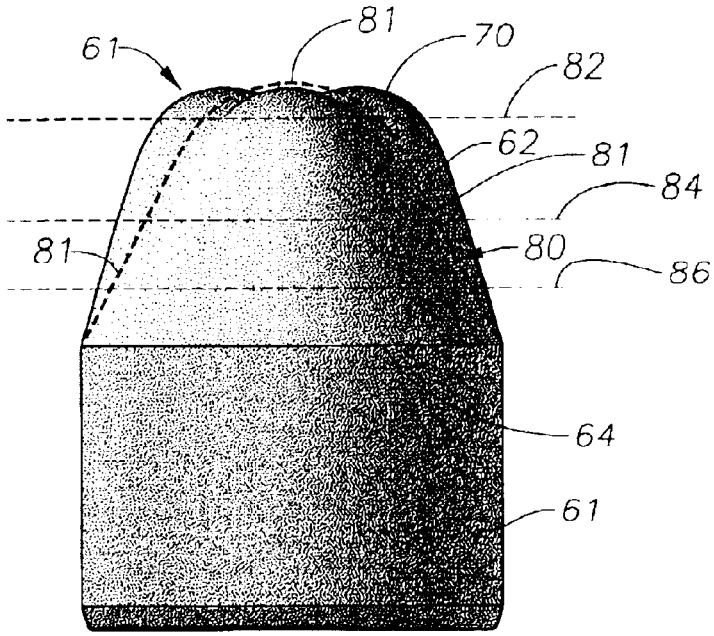
FIG. 6 is a front elevation view of the cutter element shown in FIG. 4, with a cutting profile of a conventional conical shaped insert superimposed thereon.

Referring now to FIG. 6, the cutting profile of a conventional conical insert 80 having the same base diameter and extension length as the insert 60 is shown with its cutting profile superimposed in phantom on the profile view of insert 60 previously shown in FIG. 4. More particularly, dashed line 81 represents the shape of the cutting profile of conventional and similarly sized insert 80. As shown, the cross sectional area of cutting portion 62 of cutter element 60 is substantially greater than that of conical insert 80 at most every axial position. For example, at plane 82 near the apex of conventional conical insert 80, it is shown that crown 70 of insert 60 extends laterally well beyond the cutting profile 81 of conventional insert 80. Likewise, at plane 84, the width of cutting portion 62 is substantially greater than the cutting profile 81 of conical insert 80. A substantially increased volume of cutter element material, typically tungsten carbide, at regions 82 and 84 thus provides increased strength to insert 60 to resist the lateral forces imposed on the cutting portion 62. However, the maximum bending stress that must be endured by insert 60 (as caused by the forces imposed by the formation material engaging the side of the insert) appear at the intersection 64 of cutting portion 62 and base 61, as well as the region immediately above the intersection, at the location where the element is unsupported by the cone steel. Accordingly, referring to plane 86 in FIG. 6, it is again shown that cutter element 60 includes a substantially greater volume of cutter element material at this highly-stressed region as compared to conventional conical insert 80, such that insert's 60 ability to withstand bending stress is substantially enhanced.

The larger cross-sectional area of cutting portion 62 also provides an opportunity for material enhancements over a conventional conical insert 80 of similar extension length and base diameter. In general, harder and more wear resistant grades of tungsten carbide are more susceptible to breakage than the grades that are not as hard, but that are considered tougher and better able to withstand impacts. Thus, the selection of carbide material for an insert is typically a compromise where the selection is based on the primary cutting duty that will be experienced by the insert. In the case of cutter element 60, with its cutting portion 62 having a substantially greater cross-sectional area than a conventional conical insert 80, a carbide grade may be employed that is harder and less susceptible to wear as compared to that of a standard conical insert 80. Providing such harder, more wear resistant materials in cutter elements that conventionally required tougher and less wear resistant materials may enhance bit life by providing a constant or even higher ROP over the life of the bit.

Figure 7:
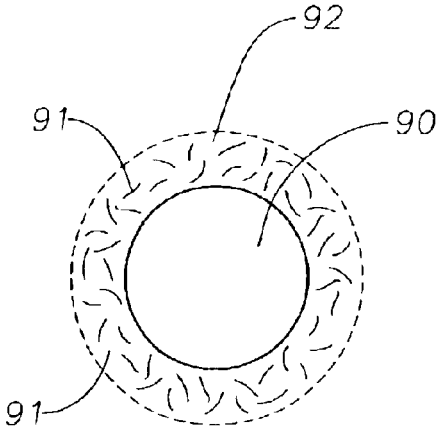
Fig. 7 (Prior Art)
FIG. 7 is a diagrammatic view of the impact on the formation material by a conventional conical shaped insert.

Cutter element 60 is not only stronger than a conventional conical insert 80 having comparable extension length and insert diameter, but it additionally provides the potential for enhanced ROP in certain hard formations as compared to conventional conical insert 80. Referring momentarily to FIG. 7, shown schematically is crater 90 formed as a conventional conical insert 80 forces its way into the rock material and displaces a portion of that material. Surrounding crater 90 is a region 92 that has experienced substantial stress from the impact of cutter element 80. Region 92 is referred to as a tensile zone caused by the Hertzian contact, or in short, as a Hertzian contact zone. Region 92 may include cracks 91, but the formation material may be such that the rock in stressed region 92 is not initially displaced as a result of the impact by insert 80. Instead, removal of the rock in region 92 may require that it be struck by other cutter elements on the drill bit before that rock material is displaced.

Figure 8:
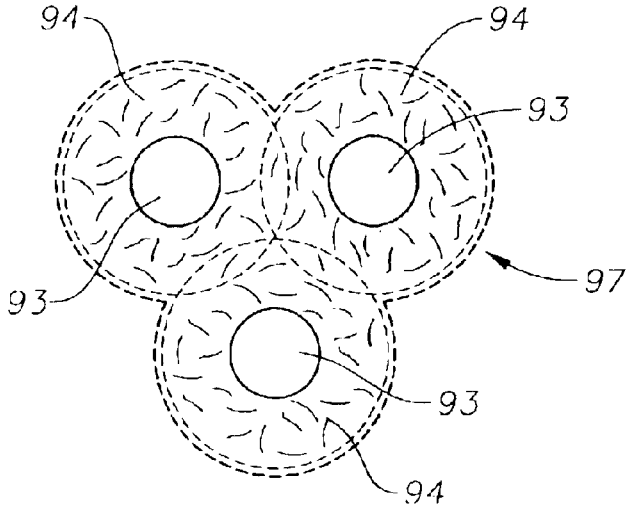
FIG. 8 is a diagrammatic view showing the impact on the formation of the cutter element shown in FIGS. 3–5.

Referring to FIG. 8, there is schematically shown a representation of the impact of cutting portion 62 of insert 60 in the same rock formation described with reference of FIG. 7. As shown, cusps 71–73 of crown 70 form spaced-apart craters 93 and surrounding Hertzian contact zones 94. Because individual cusps 71–73 are generally smaller in radius than the conical end of conventional conical insert 80, craters 93 are smaller than the crater 90 shown in FIG. 7, and the Hertzian contact zones 94 are, individually, smaller than zone 92 of FIG. 7. However, as illustrated in FIG. 8, Hertzian zones 94 overlap and extend to form a generally tri-lobed region 97 in this example. In formations susceptible to brittle fractures, a single impact of cutter element 60 may account for removal of material in the entire tri-lobed region 97, and thus remove more material than the material in Hertzian region 92 formed by insert 80 (FIG. 7).

Further, because of the cutting trajectory of insert 60 as it rotates in an inner row in a rolling cone cutter, cusps 71–73 will not all impact the formation simultaneously. Instead they will impact somewhat sequentially. This type of impact, coupled with the sliding and twisting motion imparted to the formation by the insert 60 tends to enhance the likelihood that the entire region 97, or a substantial portion thereof, will be removed with the single impact of insert 60. In comparison to FIG. 7, it will be understood that the volume of rock material removed in region 97 by insert 60 is substantially greater than that in region 92. In this manner, insert 60 potentially may offer enhanced ROP for the drill bit, particularly in formation susceptible-to brittle fractures.

Figure 9:
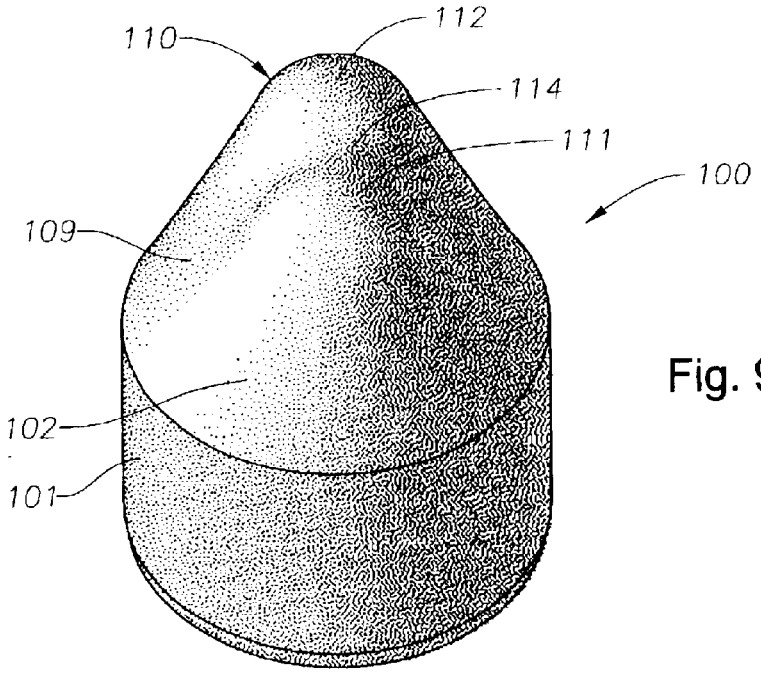
FIGS. 9–11 are, respectively, perspective, front elevation and top views of another cutter element useful in the drill bit of FIGS. 1–2.
Figure 10:
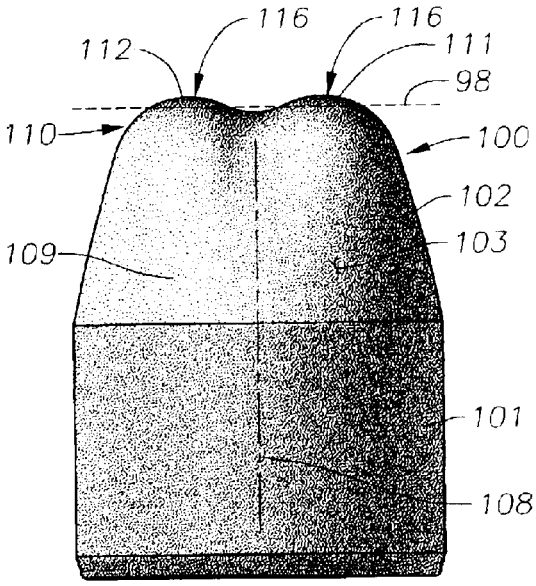
Figure 11:
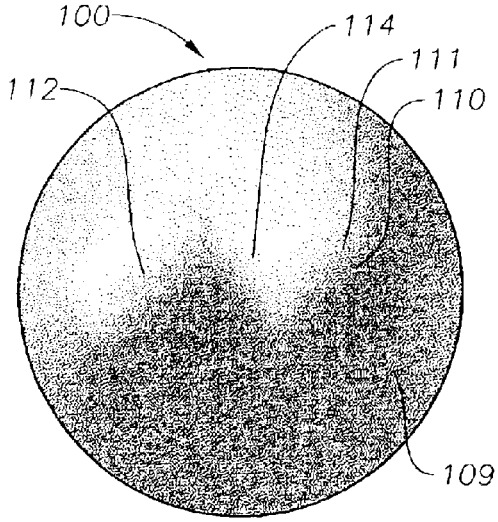

Cutter inserts that include crowns having a different number of cusps can also be employed advantageously. For example, referring to FIG. 9–11, there is shown an insert 100 having base 101 and cutting portion 102 disposed about insert axis 108. Cutting portion 102 includes a continuously contoured cutting surface 103 having a crown 110. Extending from base 101 to crown 110 is a side surface 109. Crown 110 includes cusps 111, 112 each having partial dome-shaped surfaces having the same spherical radius of curvature 116. A saddle or valley 114 bisects crown 110 and extends between cusps 111, 112, the center of the lowest portion of crown 110. As shown in FIG. 10, the intersection of plane 198 with crown 110 will yield a cross-section having two spaced apart closed figures, each in the shape of a circle. As with insert 60 of FIGS. 3–5, as insert 110 impacts the formation material, cusps 111, 112 will form spaced apart craters; however, they will also create overlapping Hertzian contact zones and, in a brittle formation, will cooperate to remove a larger volume of rock material than can be removed by a conventional conical insert. Further, because of the relatively wider cutting profile for insert 110 at compared to the conventional conical-shaped insert, insert 110 offers greater resistance to stress induced fracture of the insert. Further still, because of the rounded cutting cusps 111, 112, the cutting surface 103 of insert 100 provides a more robust and durable cutting surface as compared to the sharper, more aggressive conventional chisel insert.

As compared with the embodiment shown in FIGS. 3–5, insert 100 may have greater application in softer formations, given that the overall shape of cutting surface 103 is sharper or more aggressive than the cutter element 60 having three cusps.

Figure 14:
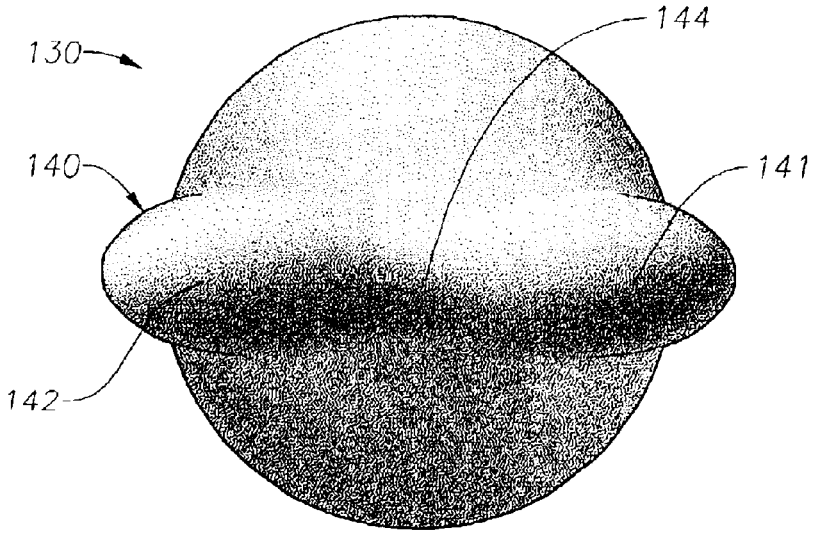
FIGS. 12–14 are, respectively, perspective, front elevation and top views of still another cutter element useful in the drill bit of FIGS. 1–2.
Figure 13:
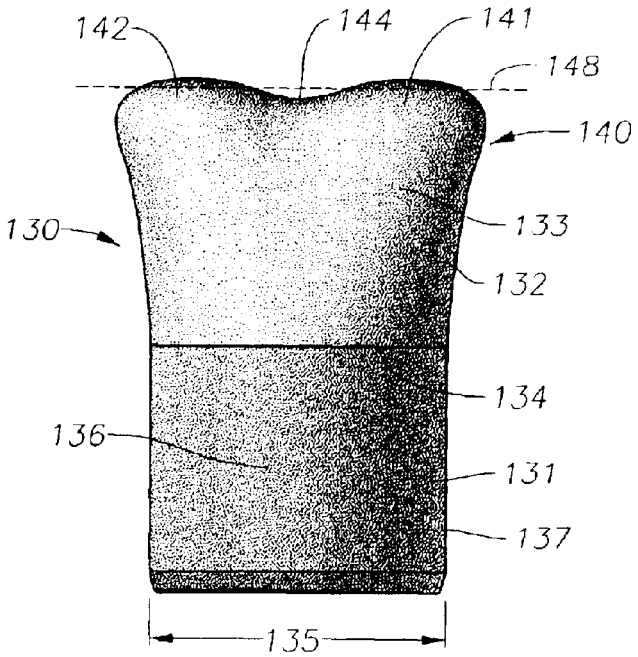
Figure 12:
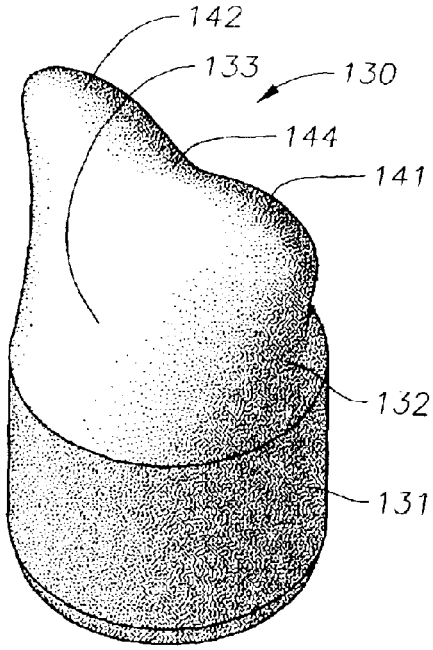

The principals discussed above with respect to the previous embodiments may also be employed in a cutter element having a cutting portion that extends beyond the outer profile of the base. For example, referring to FIGS. 12–14, insert 130 is shown to include base 131 having a diameter 135 and outer surface 136 defining base outer profile 137. Cutting portion 132 extends from base 131 at intersection 134. As shown, the cutting portion 132 includes a continuously contoured cutting surface 133 having crown 140 with partial dome-shaped cusps 141, 142 that are separated by saddle region 144. As best shown in FIGS. 13 and 14, cusps 141, 142 are separated by a substantially greater distance than cusps 111, 112 of cutter element 100 shown in FIGS. 7–9. A cross-section of crown 140 taken at plane 148 yields a pair of spaced apart closed figures that are generally circular in shape. In the appropriate brittle formation, where relatively large Hertzian contact zones are created by the impact of cusps 141, 142, a relatively large volume of rock material may be removed with a single impact of insert 130. Thus, insert 130 has a potential for a still greater ROP in certain formations.

Cutting portion 132, extending beyond diameter 135 of base 131, has what may be referred to as a negative draft with respect to the base portion 131. This design potentially allows a greater volume of the bottom hole material to be cut with a given impact of the cutter element as compared to a cutting insert having a zero or positive draft, such as insert 100 previously described. Methods of manufacturing inserts having negative drafts are known as described, for example, in U.S. Pat. No. 6,241,034. Other conventional methods of manufacturing insert 130 may be employed, such as by injection molding or by machining the element.

Figure 15:
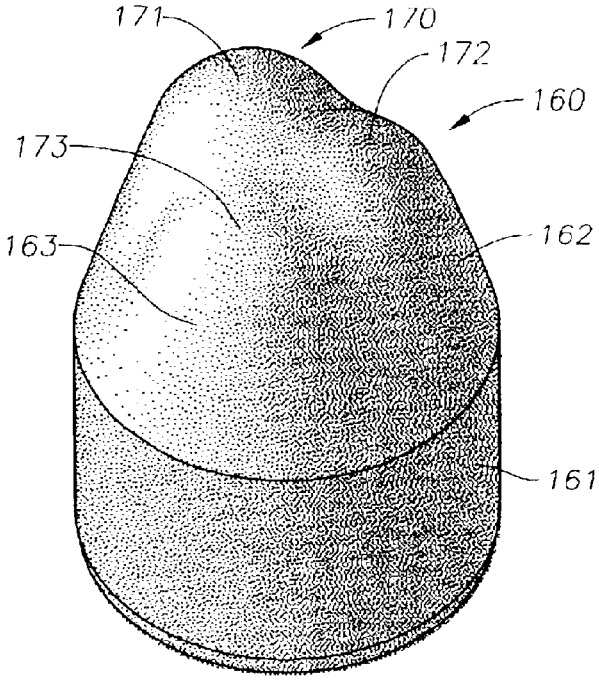
FIGS. 15–17 are, respectively, perspective, front elevation and top views of still another cutter element useful in the drill bit of FIGS. 1–2.
Figure 18:
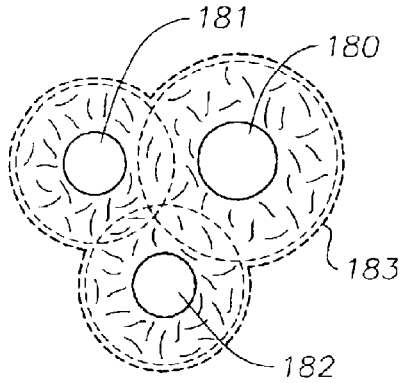
FIG. 18 is a diagrammatic view showing the impact on the formation material of the cutter element of FIGS. 15–17.
Figure 16:
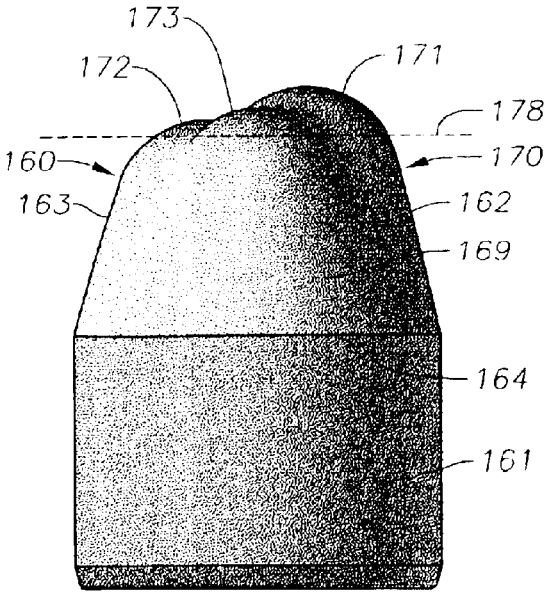
Figure 17:
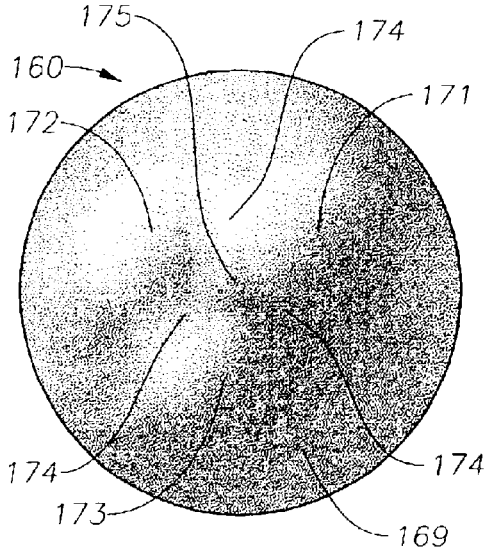

In the embodiments described to this juncture, the radius of curvature of each of the cusps of the cutting surface has been uniform. In certain formations and at given locations in the rolling cone cutter, it may be desirable to have cusps of differing curvature, or different heights, or both. Referring now to FIGS. 15–17, a cutter element 160 is shown having base 161 and cutting portion 162 extending from intersection 164. Cutting portion 162 includes continuously contoured cutting surface 163 having crown 170 with partial dome-shape cusps 171, 172, 173. Side surface 169 extends between base 161 and crown 170. As best shown, in FIG. 16, cusp 171 extends further from base 161 than cusps 172, 173 which have substantially the same extension length above base 161. In addition, as best shown in FIG. 17, the surface of cusp 171 has a larger radius of curvature than cusps 172, 173. Valleys 174 separate cusps 171–173 and intersect at a central recess 175 that is the lower most region of crown 170. A cross-section of crown 170 taken at plane 178 shown in FIG. 16 yields three spaced apart closed figures, as shown in FIG. 18. As shown, closed FIG. 180 formed by cusp 171 is larger than the closed FIGS. 181 and 182 of cusps 172, 173 respectively.

A cutter element such as insert 160 having a cutting surface 163 with one or more cusps that extend further than others in the cutting surface is believed to have particular utility in the softer of the rock formations where TCI bits are typically employed. In such formations, insert 160 may be employed in an inner row where the further extending cusp 171 can extend deeply into the formation, forming a relatively deep crater that, in conjunction with the other cusps 172, 173, creates a relatively large, tri-lobed, Hertzian contact zone 183 (FIG. 18) as compared to the zone created by the three cusps of cutter element 60 previously described. In such formations, such bottom hole cutter elements 160 are intended to enhance formation removal and to increase ROP.

Figure 19:
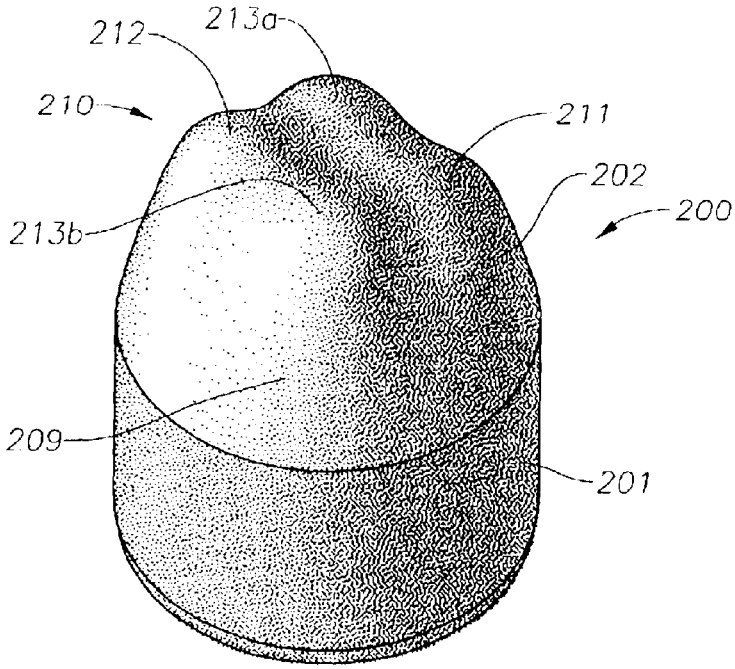
FIGS. 19–21 are, respectively, perspective, front elevation and top views of still another cutter element useful in the drill bit of FIGS. 1–2.
Figure 20:
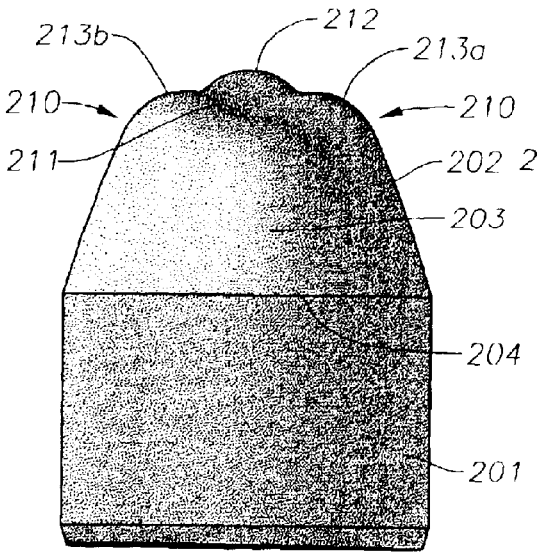
Figure 21:
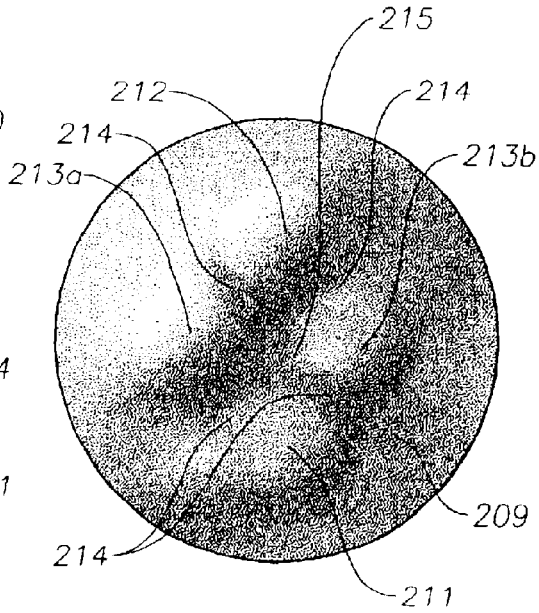

Referring to FIG. 19–21, cutter element insert 200 includes base 201 and cutting portion 202 extending therefrom. Cutting portion 202 intersects base 201 at intersection 204 and includes a continuously contoured cutting surface 203 having crown 210. Side surface 209 extends from base 201 to crown 210. Crown 210 includes a large radiused cusp 211, a small radiused cusp 212, and two intermediate radiused cusps 213*a*, 213*b*. Valleys 214 extend across crown 210 and separate each cusp, valleys 214 intersecting to form a central recess 215. As best shown in FIG. 20, small radiused cusp 212 extends further from base 201 than large radiused cusp 211 and intermediate radiused cusps 213*a, b*. Likewise, intermediate radiused cusps 213*a, b* extends further from base 201 than large radiused cusp 211. Like insert 160 previously described, insert 200 provides a relatively large (four-lobed in this instance) Hertzian contact zone to enhance formation removal in appropriate formations.

Figure 29:
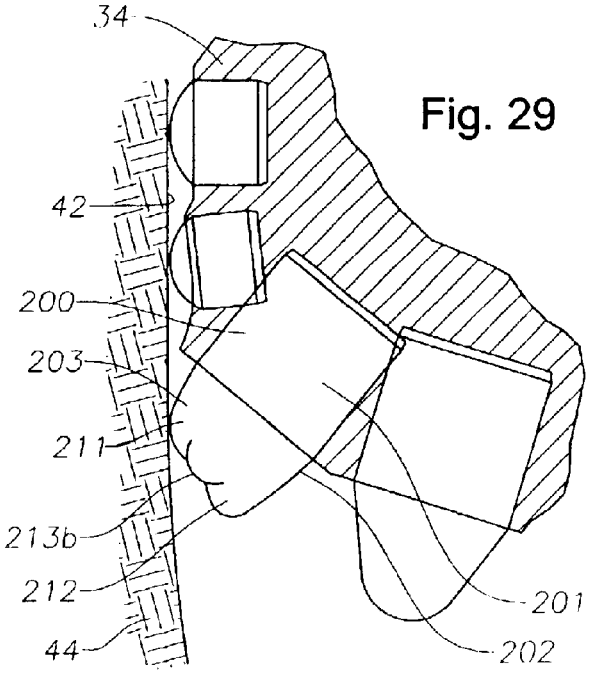
FIG. 29 is an enlarged partial cross sectional view of a rolling cone cutter having an insert with multiple, partial dome-shaped cusps employed in the gage row.

Although cutter element 200 may be employed at various locations in the rolling cone of a drill bit, element 200 is believed to have particular utility when used in the gage row. In particular, it is known that the gage row cutter elements in conventional bits tend to "round off" meaning that the side that is closest to the borehole wall when the cutter element engages the formation tends to wear more quickly than other portions of the cutter element. If wear becomes excessive, it can lead to an undergage borehole, requiring the costly step of removing the drill string and replacing the bit. Referring momentarily to FIG. 29, cutter element 200 is shown employed as a gage row cutter element and oriented in cone 34 so as to have large radiused cusp 211 closest to the borehole side wall 42 and positioned to endure the majority of the sidewall forces. All the cusps, and cusps 212 and 213, to a larger extent, attack the bottom 44 of the borehole and, particularly in brittle formations, provide overlapping Hertzian contact zones for enhancing removal of the formation material at the bottom of the borehole.

Although the embodiments described to this juncture have included cutting surfaces with crowns having partial dome-shaped cusps, the cusps need not be so shaped and may include, for example, raised peaks, berms, and other extensions having various other shapes and configurations. The cutter elements previously discussed having partial dome-shaped cusps are believed best applied in the inner and gage rows of a rolling cone cutter in a bit used to drill in hard formations. By contrast however, in the heel region of a rolling cone cutter, where a substantial portion of the cutting duty is reaming, and where the cutting element supports very little of the vertical load applied by weight-on-bit, principles of the present invention may be applied to create a cutter. element with a crown having extending cusps that are more elongate than the partial dome-shaped cusps previously described.

Figure 22:
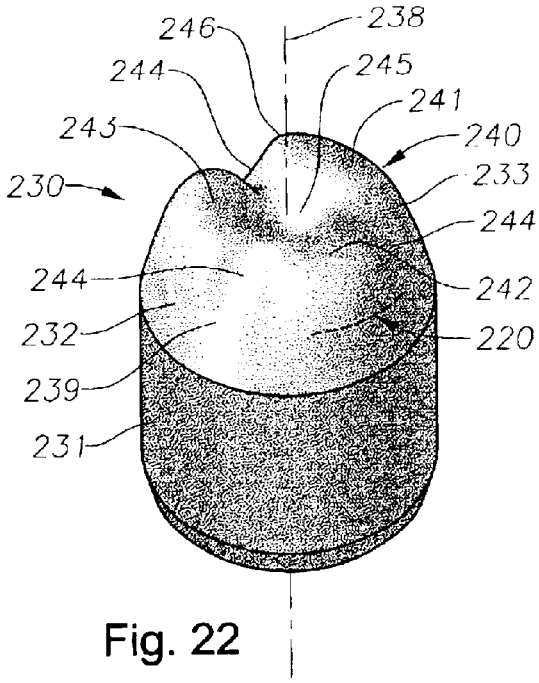
FIG. 22 is a perspective view of another cutter element useful in the drill bit of FIGS. 1–2 and having a crown on the cutting surface including cusps in the shape of berms.

For example, referring to FIG. 22, cutter insert 230 is shown to include base 231 and cutting portion 232 having continuously contoured cutting surface 233. Cutting portion 232 includes crown 240 and side surface 239 extending between base 231 and crown 240. Crown 240 includes a central recess 245 and circumferentially disposed cusps 241, 242, 243. Cusps 241–243 may generally be described as curved berms that are circumferentially-disposed about the perimeter or edge of crown 240. Berms 241–243 are separated by valleys 244. This structure thus creates a crenellated top portion-246 along the perimeter of crown 240. Valleys 244 intersect at central recess 245 and radiate therefrom between the cusps and down the side surface 239.

Figure 23:
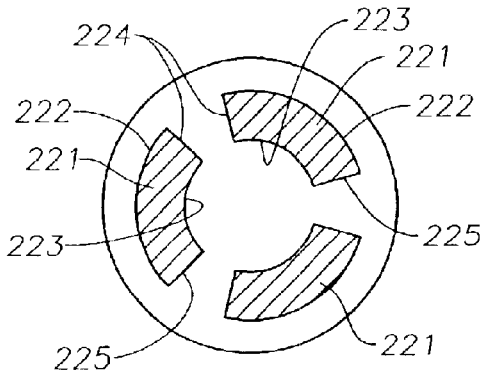
FIG. 23 is a cross sectional view taken through the crown portion of-the cutter element shown in FIG. 22.

The cutting surface 233 thus presents numerous and varied cutting edges to the sidewall formation. For example, a plane perpendicular to cutter axis 238 taken through cusps 241–243 at region 220 yields the cross section shown in FIG. 23. As shown, the cross section includes three closed FIGS. 221 each of which includes four cutting edges 222, 223, 224, 225 which define the perimeter of the closed FIGS. 221. No matter the orientation of cutter element 230, the formation material impacted by the cutter element will be exposed to various of the cutting edges 222–225 as the material is engaged by that cutter element as it swings along its cutting trajectory.

Figure 24:
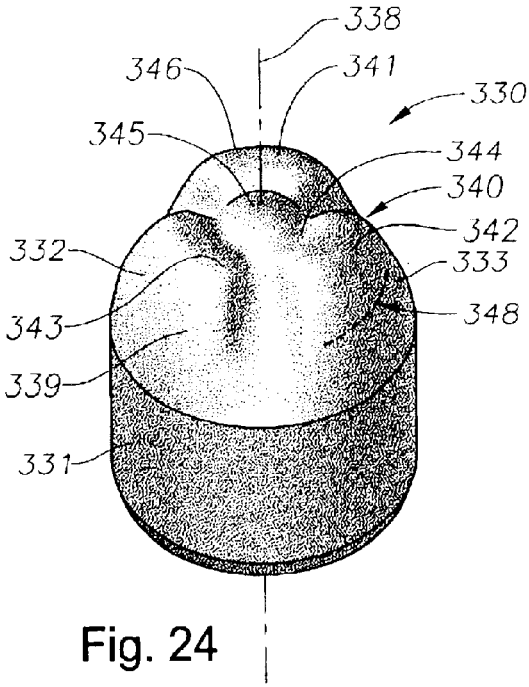
FIG. 24 is a perspective view of another cutter element useful in the drill bit of FIGS. 1–2.
Figure 25:
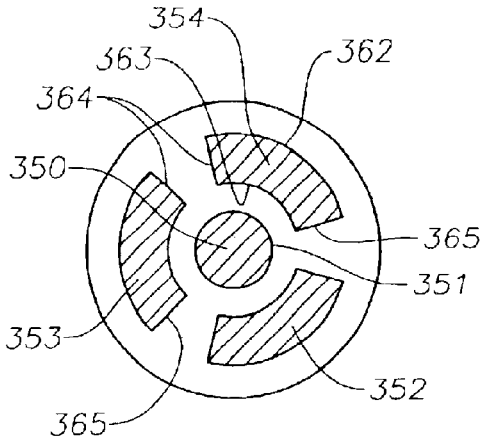
FIG. 25 is a cross sectional view taken through the crown portion of the cutter element of FIG. 24.

A cutter element similar to that shown in FIG. 22 is depicted in FIG. 24 where cutter element 330 is shown to include base 331 and cutting portion 332 having a continuously contoured cutting surface 333. Cutting portion 332 includes crown 340 and side surfaces 339 extending between the base 331 and the crown 340. In this embodiment, crown 340 includes a centrally positioned cusp 345. Curved, berm like cusps 341, 342, 343 are circumferentially spaced about the perimeter of crown 340. A circumferential valley 344 is formed between central cusp 345 and perimeter cusps 341–343. Radiating valleys 344 intersect circumferential valley 344 and radiate down the side surface 339 forming a crenellated top portion 346 along the perimeter of crown 340. Referring to FIG. 24 and 25, a cross-section taken perpendicular to cutter axis 338 at plane 348 and passing through berm-shaped cusps 341–343 and central cusp 345 yields four closed figures as shown in FIG. 25. Central closed FIG. 350 provides a generally circular cutting edge 351. Closed FIGS. 352–354 surround closed FIG. 350 and each provides four cutting edges 362–365. Compared with the cutter element 230 of FIG. 22, cutter element 330 of FIG. 24 provides still additional cutting edges 351. Cutter element 330, like cutter element 230 has particular application in the heel row of a rolling cone cutter when used in relatively hard formation; however, elements 230, 330 may also be employed in other locations.

Figure 26:
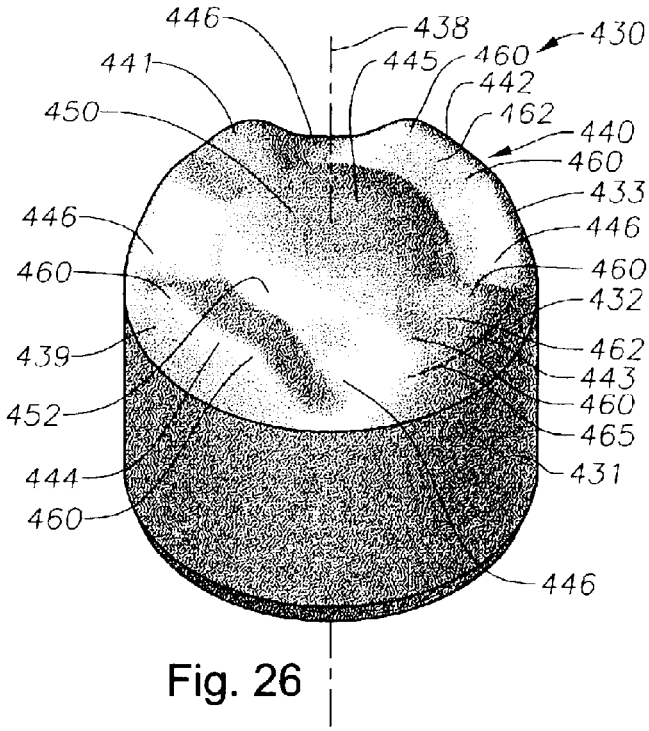
FIG. 26 is a perspective view of still another cutter element useful in a drill bit of FIGS. 1–2.

Still additional cutting edges can be provided in a crown of a cutting surface by providing the circumferentially disposed, berm shaped cusps with peaks and undulations formed on the upper surface of the cusp. For example, referring to FIG. 26, there is shown a cutter insert 430 having base 431 and cutting portion 432 extending therefrom and including a continuously contoured cutting surface 433. Cutting portion 432 includes crown 440 and side surface 439 extending between base 431 and crown 440. In this embodiment, crown 440 includes four circumferentially disposed, berm shaped cusps 441–444 separated by valleys 446. Valleys 446 generally extend radially from central axis 438. Central to crown 440 is central cusp 445 having a generally flat upper surface 450. In this embodiment, the substantially flat upper surface 450 of central cusp 445 has a diameter equal to approximately 50 percent of the diameter of base 431. A circumferential valley 452 is disposed between central cusp 445 and the circumferentially disposed cusps 441–444. Each circumferentially disposed cusp 441–444 includes two apexes or peaks 460 separated by a central saddle 462. As shown in FIG. 26, the depth of saddle 462 is more shallow than the depth of valley 446.

Figure 27:
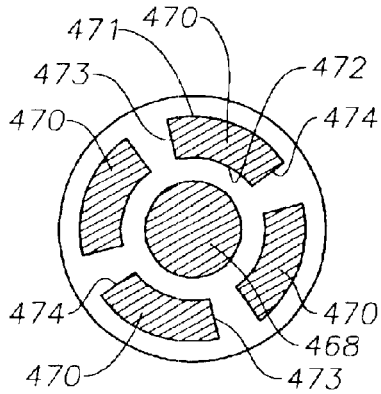
FIGS. 27–28 are cross sectional views taken through the crown of the cutting portion of the cutter element shown in FIG. 26.
Figure 28:
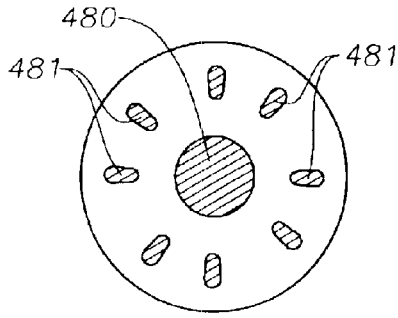

Referring now to FIGS. 26 and 27, a cross-section of crown 440 taken at plane 465 generally yields the cross-section shown having central circular closed FIG. 468 surrounding by four curved closed FIGS. 470, each of which includes four side cutting surfaces 471–474. Referring to FIG. 28, a cross-section of crown 440 taken above plane 465 and above the lower surface of saddle 462 but beneath the apexes 460 of the circumferentially disposed cusps 441–444 yields a different set of closed figures, one have a central circular closed FIG. 480 surrounded by eight generally oval shaped closed FIGS. 481 disposed about central closed FIG. 480.

The cutter element 430 shown in FIG. 26 thus provides a relatively large number of cutting edges as particularly advantageous for use in the heel surface of a rolling cone cutter, a position where the cutter element provides a substantial degree of reaming or scrapping. The crown of insert 430 provides a relatively aggressive cutting surface and multiple cutting edges, both before and after wear has occurred to the crown 440 and to cusps 441–444, 445.

Although the circumferentially-disposed cusps of the crowns in the cutter elements described above with reference to FIGS. 22–28 have been shown and described as being generally identical within each crown, the cusps can instead have different shapes and sizes within the same crown. Further, although the crowns of these embodiments were shown having three or four such cusps, crowns having a greater or lesser number of cusps may be successfully employed.

Figure 30:
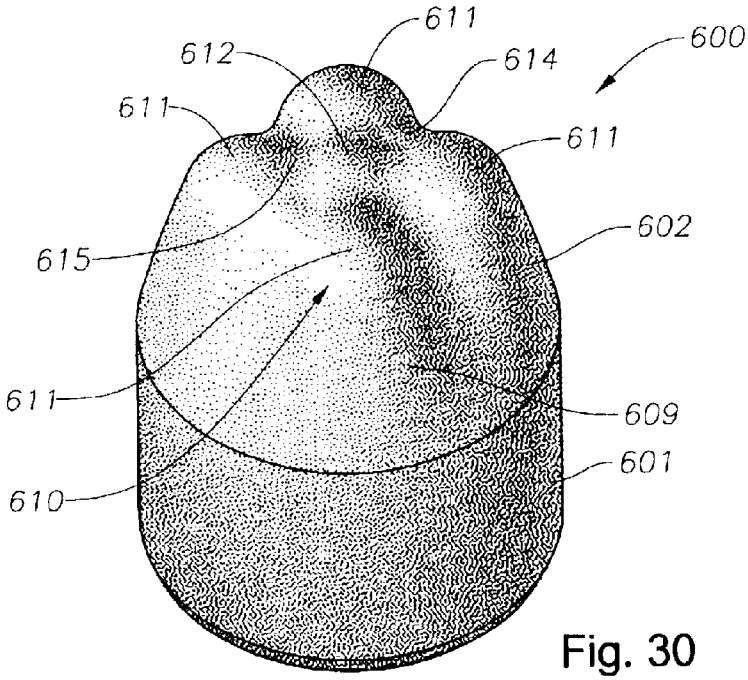
FIGS. 30, 31 are, respectively, perspective and front elevation views of another cutter element useful in the drill bit of FIG. 1–2.
Figure 31:
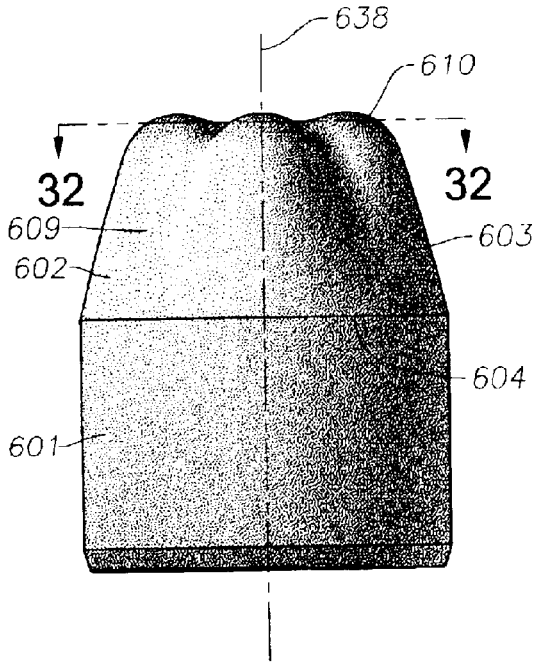
Figure 32:
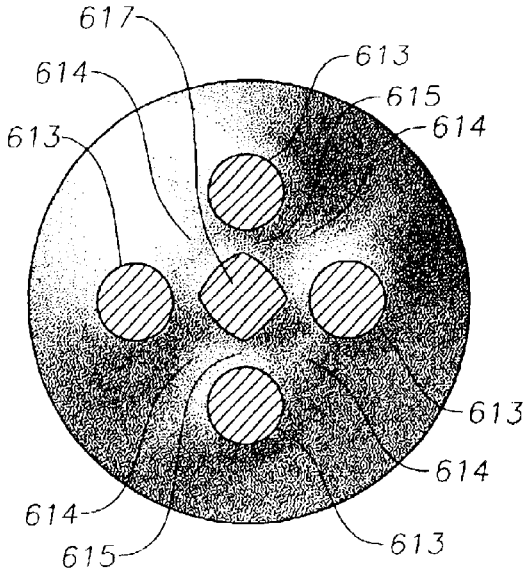
FIG. 32 is a cross-sectional view of the cutter element shown in FIG. 31 taken at plane 32—32 passing through the cusps of the cutter element.

Cutter elements having a plurality of rounded or partially dome-shaped cusps may also be provided with a centrally positioned cusp. Referring to FIGS. 30–32, cutter element 600 includes a base 601 and cutting portion 602 extending therefrom. Cutting portion 602 intersects base 601 at intersection 604 and preferably includes a continuously contoured cutting surface 603 with crown 610. Side surface 609 extends from base 601 to crown 610. Crown 610 includes four partial dome-shaped cusps 611 and a central partial dome-shaped cusp 612. In the embodiment shown, cusps 611, 612 have substantially identical spherical radii of curvature and similar extension lengths, although the cusps may be formed to have different extensions and different radii of curvature. A valley 614 extends between each cusp 611 and intersects a valley 615 that generally encircles central cusp 612.

Referring to FIGS. 31, 32, a cross-section passing through cusps 611 and cusp 612 creates four closed FIGS. 613 generally encircling closed FIG. 617. Like various inserts previously described, insert 600 will thus produce a relatively large Hertzian contact zone to enhance formation removal, a zone that, in this instance, is created by five craters as formed by lobes 611, 612.

Figure 33:
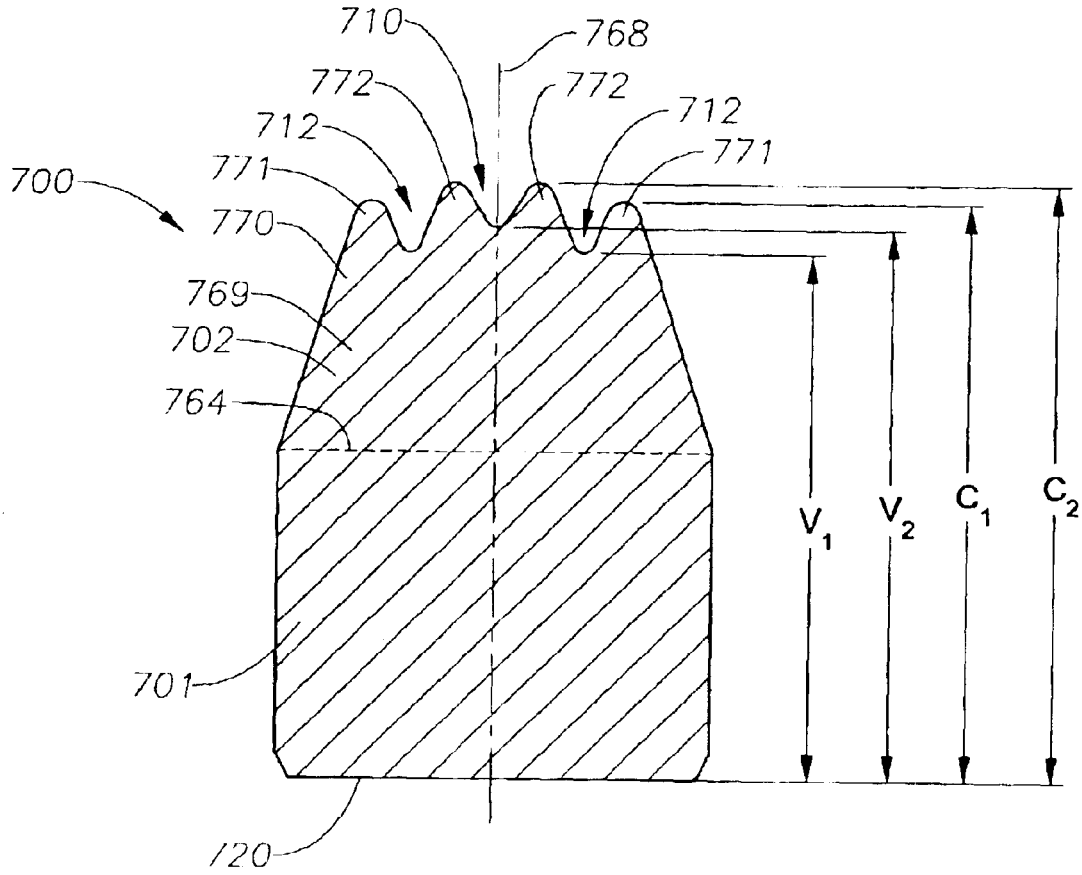
FIG. 33 is a cross-sectional view of another cutter element useful in the drill bit of FIGS. 1 and 2

It is to be appreciated that, just as the height of the various cusps on the crown portion of the cutter element may vary, the depth of the valleys formed in the crown may differ. Referring to FIG. 33, a cutter element insert 700 is shown in cross section. Insert 700 includes base portion 701 and cutting portion 702 extending therefrom and meeting base 701 at intersection 764. Cutting portion 702 further includes a side surface 769 extending between base 701 and crown 770. Insert 700 is substantially similar to insert 430 previously described with respect to FIG. 26; however, insert 700 of FIG. 33 includes a central recess or valley 710 formed at the intersection of crown 770 and insert axis 768. Crown 770 includes circumferentially disposed berm-shaped cusps 771 along its periphery, and a central ring-shaped cusp 772 which may be crenellated. An annular valley 712 encircles ring-shaped cusp 772 and thereby separates cusp 772 and berm-shaped cusps 771. Central ring-shaped cusp 772 defines the overall length of insert 700 which is equal to $C_2$ as measured from the bottom surface 720 of base 701 to the point on cusp 772 that is most distant from bottom surface 720 as measured parallel to axis 768. As shown, the berm-shaped cusps 771 have a height or extension length equal to $C_1$ that is less than $C_2$. Likewise, in this embodiment, the valleys between the cusps have depths that differ. That is, the outermost valley 712 extends further toward bottom surface 720 and thus is deeper than the central valley 710. As shown in FIG. 33, central valley 710 has its lowermost point at a height of $V_2$ and has a depth equal to $C_2-V_2$. Outer valley 712 has its lowermost point at a height equal to $V_1$ and has a depth equal to $C_2-V_1$. While the depth of the valleys between cusps may vary depending upon the specific formation and application, it is preferred that the depth of each valley be between five percent and 50 percent of the total overall length of the insert. More particularly, referring to FIG. 33, $V_1$ and $V_2$ should each be within the range of 50 percent to 95 percent of $C_2$, and more preferably, between 75% and 95% of $V_2$.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for use in a drill bit for drilling a borehole through earthen formation comprising:

a base portion;

a cutting portion extending from said base portion, said cutting portion including a crown and tapered sides extending from said base to said crown;

wherein said crown includes a plurality of spaced apart cusps with valleys between said cusps.

2. The cutter element of claim 1 wherein at least some of said plurality of cusps are partial dome-shaped cusps.

3. The cutter element of claim 2 wherein said partial dome-shaped cusps have a uniform spherical radius of curvature.

4. The cutter element of claim 2 wherein the spherical radii of curvature of at least two dome-shaped cusps differ.

5. The cutter element of claim 1 wherein said cutter element defines an overall length and wherein said valleys have a depth equal to at least 5% of said overall length.

6. A cutter element for use in a drill bit for drilling a borehole through earthen formation comprising:

a base portion;

a cutting portion extending from said base portion, said cutting portion including a crown and sides extending from said base to said crown;

wherein said crown includes a plurality of spaced apart cusps with valleys between said cusps and wherein said cusps extend to different heights relative to said base.

7. The cutter element of claim 6 wherein at least two of said cusps are partial dome-shaped cusps, and wherein the radii of curvature of said dome-shaped cusps differ.

8. A cutter element for use in a drill bit for drilling a borehole through earthen formation comprising:

a base portion;

a cutting portion extending from said base portion, said cutting portion including a crown and sides extending from said base to said crown;

wherein said crown includes a plurality of spaced apart cusps with valleys between said cusps and wherein said crown includes a plurality of dome-shaped cusps; and wherein said crown is formed with a negative draft relative to said base.

9. A cutter element for use in a drill bit for drilling a borehole through earthen formation comprising:

a base portion;

a cutting portion extending from said base portion, said cutting portion including a crown and sides extending from said base to said crown;

wherein said crown includes a plurality of spaced apart cusps with valleys between said cusps and wherein said cusps comprise arcuate-shaped berms circumferentially spaced about said crown.

10. The cutter element of claim 9 wherein said crown further includes a central recess within said circumferentially spaced berms.

11. The cutter element of claim 9 wherein said crown further includes a central cusp and a circumferential valley between said central cusp and said circumferentially spaced berms.

12. The cutter element of claim 11 wherein said central cusp has a top surface that is substantially flat.

13. The cutter element of claim 11 wherein said base has a circular outer profile and wherein said central cusp has a diameter of at least 33% of the diameter of said base.

14. A cutter element for a rolling cone cutter of a drill bit, comprising:

a base portion extending into the rolling cone cutter;

a cutting portion extending from said base portion and including a cutter axis and a cutting surface, said cutting surface having a crown spaced apart from said base and a side surface extending from said base to said crown;

wherein said crown includes a plurality of cusps extending beyond one or more recesses in said crown such that a planar cross-section of said crown taken perpendicular to said cutter axis at at least one axial position intersects said crown in a plurality of spaced apart closed figures.

15. The cutter element of claim 14 wherein said closed figures are non-circular.

16. The cutter element of claim 15 wherein said closed figures have at least two different shapes.

17. The cutter element of claim 14 wherein at least two of said closed figures are circular and have differing radii.

18. A cutter element of claim 14 wherein said closed figures include a central closed figure and a plurality of other closed figures circumferentially spaced about said central closed figure.

19. The cutter element of claim 18 wherein said circumferentially spaced closed figures are similarly shaped.

20. The cutter element of claim 14 wherein said crown include a central depression and wherein said closed figures are circumferentially spaced about said depression.

21. The cutter element of claim 14 wherein at least one of said cusps includes a saddle formed between two apexes.

22. The cutter element of claim 21 wherein said cusps include arcuate-shaped berms circumferentially spaced along the perimeter of said crown.

23. The cutter element of claim 22 further comprising a central cusp spaced within said plurality of circumferentially spaced cusps.

24. The cutter element of claim 14 wherein said plurality of cusps include at least two partial dome-shaped cusps.

25. The cutter element of claim 24 wherein said partial dome-shaped cusps have different spherical radii.

26. The cutter element of claim 24 wherein partial dome-shaped cusps extend different heights relative to said base.

27. The cutter element of claim 24 wherein said crown includes three partial dome-shaped cusps disposed on said crown about a central recess.

28. The cutter element of claim 14 wherein said cutter element has an overall length L and wherein said crown includes valleys separating said cusps, and wherein said valleys have depths that are between 5% and 25% of L.

29. A drill bit for cutting through earthen formations and creating a borehole comprising:

a bit body having a bit axis;

at least one rolling cone cutter rotatably mounted on said bit body, said cone cutter including a back face, a heel surface adjacent to said back face, and a generally conical surface adjacent to said heel surface;

a plurality of heel row cutter elements mounted in said cone cutter in a circumferential row in said heel surface, wherein at least one of said heel row cutter elements comprises a base portion secured within said heel surface and a cutting portion extending therefrom, said cutting portion having a cutting surface including a crown;

wherein said crown includes a plurality of cusps circumferentially spaced about said crown and separated by valleys between said cusps.

30. The drill bit of claim 29 wherein said cutting surface includes cusps circumferentially disposed about said crown forming a crenellated cutting surface.

31. The drill bit of claim 30 wherein said central cusp includes a generally circular flat upper surface.

32. The drill bit of claim 30 wherein said cutting surface of said heel row cutter elements is continuously contoured.

33. A drill bit of claim 29 wherein said crown on at least two of said heel row cutter elements includes a central cusp separated from said circumferentially-spaced cusps by a circumferential valley.

34. The drill bit of claim 29 wherein said circumferentially spaced cusps include at least two cusps having a saddle formed between two apexes.

35. The drill bit of claim 29 wherein said plurality of heel row cutter elements include three or more circumferentially disposed cusps.

36. The drill bit of claim 29 wherein said heel row cutter elements include at least two circumferentially spaced cusps having a saddle disposed between a pair of apexes, said valley between said cusps being deeper than said saddle between said apexes.

37. The drill bit of claim 36 wherein said heel row cutter elements include a central cusp in said crown that is encircled by said plurality of circumferentially spaced cusps.

38. The drill bit of claim 29 further comprising:

a plurality of inner row cutter elements mounted in said cone cutter in a circumferential inner row in said generally conical surface, said inner row cutter elements comprising a base portion secured within said conical surface and a cutting portion extending therefrom, said cutting portion having a cutting surface including a crown;

wherein said crown includes a plurality of spaced apart cusps with valleys between said cusps.

39. The drill bit of claim 38 wherein at least one of said plurality of cusps on said cutting surface of said inner row cutter elements is a partial dome-shaped cusp.

40. The drill bit of claim 39 wherein at least two of said plurality of cusps on said cutting surface of said inner row cutter elements are partial dome shaped cusps having a uniform spherical radius of curvature.

41. The drill bit of claim 39 wherein at least two of said plurality of cusps on said cutting surface of said inner row cutter elements are partial dome-shaped cusps having differing spherical radii of curvature.

42. The drill bit of claim 38 wherein said crowns of said inner row cutter elements include cusps that extend to different heights relative to said base.

43. The drill bit of claim 42 wherein said cusps extending to different heights are generally dome-shaped cusps having differing spherical radii of curvature.

44. An insert for use in a rolling cone of a drill bit comprising:

a base portion;

a cutting portion extending from said base portion having an insert axis and a continuously contoured cutting surface, said cutting surface including a plurality of cusps disposed about said insert axis, wherein said continuously contoured cutting surface further includes a crown portion and a tapered side surface extending from said base to said crown, said cusps extending from said crown.

45. The insert of claim 44 wherein said side surface tapers inwardly from said base portion toward said insert axis.

46. The insert of claim 44 wherein side surface tapers outwardly from said base portion away from said insert axis.

47. The insert of claim 44 wherein said plurality of cusps include at least two cusps having partial dome-shaped cutting surfaces.

48. The insert of claim 47 wherein said partial dome-shaped cutting surfaces of said cusps have spherical radii, and wherein said spherical radius of at least two of said cusps differ.

49. The insert of claim 44 wherein at least two of said cusps extend to different heights relative to said base.

50. The insert of claim 44 wherein said insert includes a generally cylindrical side surface extending between said base and said continuously contoured cutting surface.

51. The insert of claim 50 wherein said cusps include arcuate-shaped berms formed about the perimeter said cutting surface.

52. The insert of claim 51 wherein said cutting surface further includes a cusp centrally disposed within said arcuate shaped berms.

53. The insert of claim 51 wherein said arcuate-shaped berms are separated by valleys at the ends of said berms and wherein one or more of said arcuate-shaped berms includes a pair of apexes separated by a saddle portion; and wherein the depth of said valleys exceeds the depth of said saddle.

54. The insert of claim 44 wherein said cutting surface includes at least one recess between two cusps such that a planar cross section of said cutting surface taken perpendicular to said insert axis at at least one axial position intersects said cutting surface in the plurality of spaced apart closed figures; and wherein the perimeters of said closed figures include line segments having differing radii of curvature.

55. The insert of claim 54 wherein said closed figures include a circle centrally disposed within other closed figures that include a pair of concentric curved segments.

56. The insert of claim 44 wherein said insert has an overall length and wherein said cusps are separated by valleys that have a depth of between 5% and 50% of said overall length.

57. The insert of claim 56 wherein said valleys differ in depth.

58. A drill bit for cutting through earthen formations and creating a borehole comprising:

a bit body having a bit axis;

at least one rolling cone cutter rotatably mounted on said bit body;

a plurality of cutter elements mounted in said cone cutter in a circumferential row, wherein at least one of said cutter elements in said row comprises a base portion secured within said cone cutter and a cutting portion extending therefrom, said cutting portion comprising a cutting surface including a crown and a tapered side surface extending from said base to said crown; and wherein said crown comprises a plurality of spaced apart cusps with valleys between said cusps.

59. The drill bit of claim 58 wherein said tapered side surface is oriented such that said crown of said cutter element is formed with a negative draft relative to said base.

60. The drill bit of claim 58 wherein said tapered side surface is oriented such that said crown of said cutter element is formed with a positive draft relative to said base.

61. The drill bit of claim 58 wherein said cone cutter includes a back face, a heel surface adjacent to said back face, and a generally conical surface adjacent to said heel surface, and wherein said circumferential row is disposed on said generally conical surface.

62. The cutter element of claim 58 wherein at least some of said plurality of cusps are partial dome-shaped cusps.

63. The cutter element of claim 62 wherein the spherical radii of curvature of at least two dome-shaped cusps differ.

64. The cutter element of claim 58 wherein at least some of said plurality of cusps extend to different heights relative to said base.

65. The drill bit of claim 58 wherein said cone cutter includes a back face, a heel surface adjacent to said back face, and a generally conical surface adjacent to said heel surface, and wherein said circumferential row is disposed on said heel surface, and wherein said cusps comprise arcuate-shaped berms circumferentially spaced about said crown.

* * * * *